US005100249A

United States Patent [19]

Wochinski et al.

[11] Patent Number: 5,100,249

[45] Date of Patent: Mar. 31, 1992

[54] CHECK PROTECTOR WITH MEANS FOR PRINTING AMOUNT IN BANDS OF DIFFERENT COLORS

[75] Inventors: Ronald F. Wochinski, Palatine; John S. Schubert, Arlington Heights; Victor L. Salmons, Waukegan, all of Ill.

[73] Assignee: The Hedman Company, Chicago, Ill.

[21] Appl. No.: 588,452

[22] Filed: Sep. 26, 1990

[51] Int. Cl.[5] ..... B41J 31/00

[52] U.S. Cl. ..... 400/191; 400/240; 400/216.1

[58] Field of Search ..... 400/82, 137, 216.1, 400/240, 191; 101/332; 346/46; 428/916

[56] References Cited

U.S. PATENT DOCUMENTS

| | | | |
|---|---|---|---|
| 1,144,742 | 6/1915 | Todd et al. | 283/70 |
| 2,733,656 | 2/1956 | Gottsching | 101/175 |
| 3,858,705 | 1/1975 | Reitano | 400/240.4 |
| 4,088,218 | 5/1978 | Depew | 400/208 |
| 4,240,345 | 12/1980 | Kyogoku | 101/103 |
| 4,426,168 | 1/1984 | Jozuka et al. | 400/224 |
| 4,662,651 | 5/1987 | Mowry, Jr. | 283/70 |

FOREIGN PATENT DOCUMENTS

| | | | |
|---|---|---|---|
| 0072556 | 4/1988 | Japan | 400/121 |

*Primary Examiner*—Edgar S. Burr
*Assistant Examiner*—Christopher A. Bennett
*Attorney, Agent, or Firm*—Emrich & Dithmar

[57] ABSTRACT

The check protector comprises a print head with a plurality of parallel pins in a vertical line perpendicular to the direction of movement of the head. The ribbon in the check protector has at least two bands, one band being associated with half the print wires and the other band being associated with the rest of the print wires. In this manner, the amount on a check is imprinted in alternating bands of color to make alteration difficult.

4 Claims, 1 Drawing Sheet

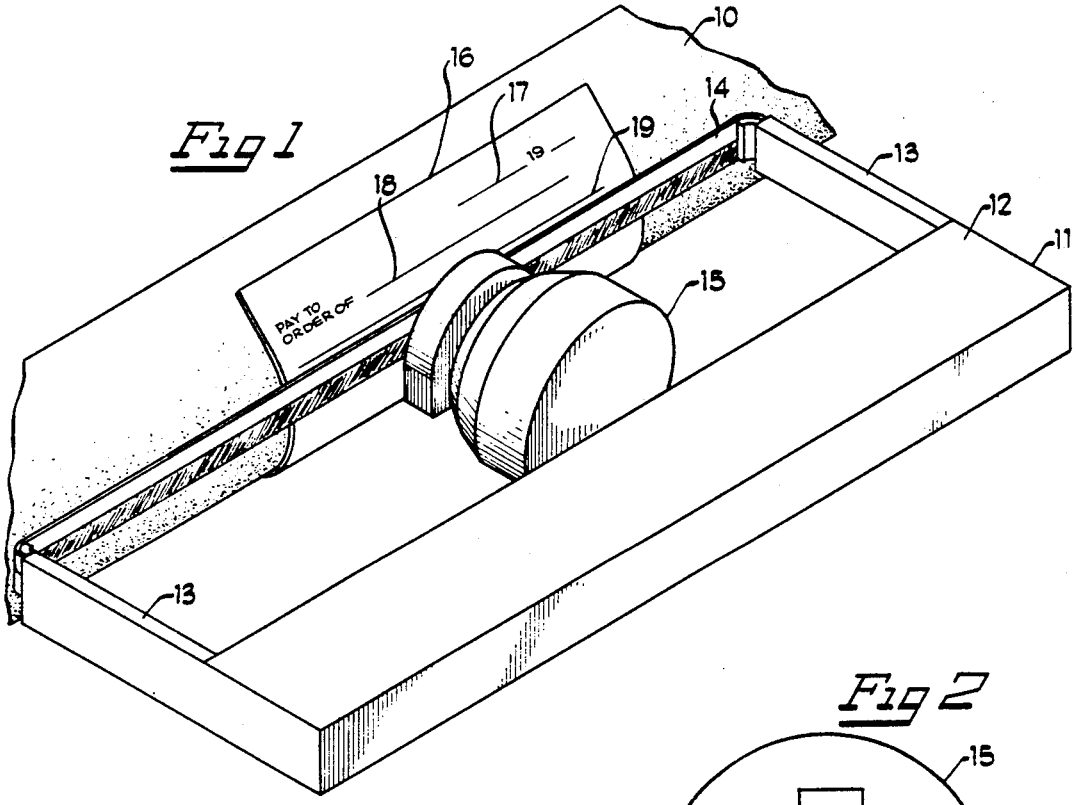
Fig 1
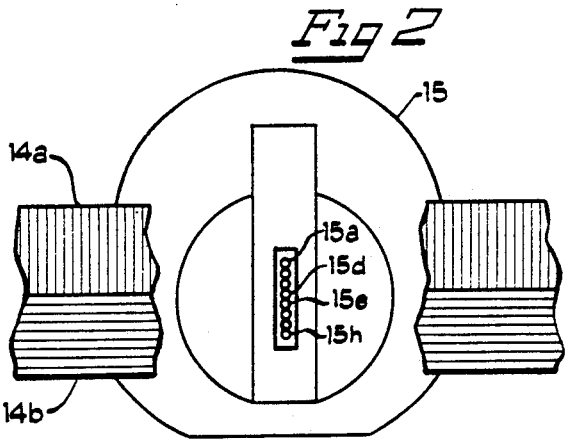
Fig 2
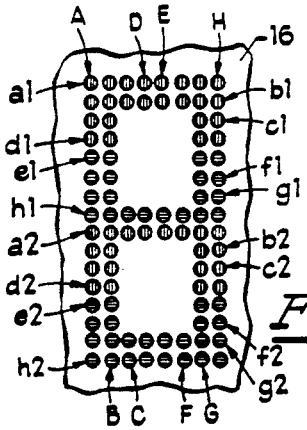
Fig 3
Fig 4
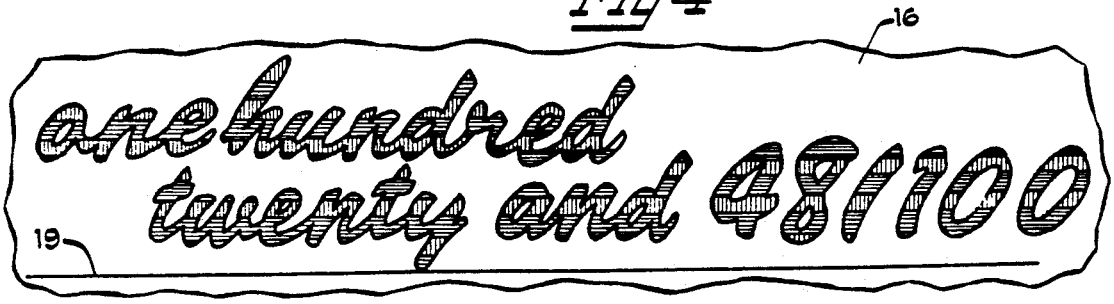

CHECK PROTECTOR WITH MEANS FOR PRINTING AMOUNT IN BANDS OF DIFFERENT COLORS

BACKGROUND OF THE INVENTION

Devices to protect against alteration of the amount imprinted on a check have been in the marketplace for many years. One popular approach has been to macerate the amount directly into the check. Indelible ink is absorbed by the shredded paper fibers making it difficult to alter the amount. However, use of maceration in machines that imprint checks on a continuous basis undesirably slows down the machines.

SUMMARY OF THE INVENTION

It is, therefore, an important object of the present invention to provide a check protector which does not utilize maceration to preclude alteration of a check amount.

Another object is to provide a check protector which imprints the amount in horizontal bands of color to make alteration of the check more difficult.

In summary, there is provided a check protector having platen means, a ribbon cassette containing an inked ribbon, a print head mechanism mounted for reciprocally moving relative to the check along a print line to print characters on the check, the inked ribbon being divided into at least two color bands parallel to the print line, the print head mechanism including a plurality of parallel print wires arranged in a line perpendicular to the print line, some of the print wires being aligned with the first band and the rest of the print wires being aligned with the second band, whereby the amount imprinted on the check will have at least two bands corresponding to the two colors.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 1 is a perspective view of a portion of a check protector incorporating the features of the present invention;

FIG. 2 is an elevational view through the ribbon of the print head;

FIG. 3 is a fragmentary view of one of the characters made by the check protector of FIG. 1; and FIG. 4 depicts an amount imprinted by the check protector.

DETAILED DESCRIPTION OF THE PREFERRED EMBODIMENT

The portion of a check protector depicted in FIG. 1 includes a platen 10. A mechanism (not shown) rotates the platen to move paper positioned thereon upwardly after each line is printed. The check protector further comprises means (not shown) for mounting a ribbon cassette 11 having a housing 12 and two arms 13. In the housing 12 is a ribbon 14 which extends through the arms. The ribbon moves forwardly through one of the arms 13 and is taken up through the other arm 13. The check protector further comprises a print head 15 which is on a carriage (not shown) reciprocally movable in a direction parallel to the ribbon 14.

Carried by and positioned on the platen 10 is a check 16 having the usual line 17 for the date, line 18 for the payee, line 19 for the amount, etc. Ribbon 14 basically extends in the same direction as print lines 17, 18 and 19 and print wires 15*a–h* are in a line perpendicular to such print line.

Referring to FIG. 2, the print head 15 includes eight parallel print wires 15*a* to 15*h* arranged in a vertical line, that is, in a line perpendicular to the horizontal direction of movement of print head 15. A wire actuating mechanism (not shown) selectively actuates the print wires to strike the ribbon 14 and thereby imprint upon check 16. The ribbon 14 has two color bands 14*a* and 14*b*. For example, the band 14*a* could be red and the band 14*b* blue. The four wires 15*a* to 15*d* are aligned with band 14*a* and the four wires 15*e* to 15*h* are aligned with band 14*b*, as can be seen in FIG. 2. In other words, the boundary between the bands 14*a* and 14*b* is located between wires 15*b* and 15*e*. Thus, when the wire actuating mechanism actuates any of wires 15*a* to 15*d*, the color corresponding to band 14*a* will be imprinted on check 16; if it actuates any of wires 15*e* to 15*h*, the color corresponding to band 14*b* will be imprinted on the check.

FIG. 3 depicts a specific character formed by two passes of print head 15. The print head moves across the check, from left to right and returns after completing a line, to start a second pass. During the first pass, the top half of the FIG. "8" depicted in FIG. 3 is imprinted on check 16, and during the second pass, the bottom half is produced. The character is 16 dots high. The first eight rows are formed in the first pass, and, therefore, are denoted a1 to h1. Rows a2 to h2 are produced on the second pass. The columns are marked A through H. Thus, the dots in column A, rows al to d1 are the color of band 14*a*, i.e., red in the example, and the dots in that same column A, for e1 to h1, are the color of the band 14*b*, or blue in the example. The dots in columns B, G and H will be the same as in column A. The dots in columns C to F will only be produced in response to wires 15*a*, 15*b* and 15*h* because the others are not activated and, therefore, the colors of the dots in columns C to F, rows al and b1 will be red, and the colors of the dots in those columns, row h1 will be blue.

The print head 15 continues to the right-hand end of check 16 and returns to create the lower half of the FIG. "8." It first generates column A, rows a2 to h2. The dots in rows a2 to d2 will be produced by the band 14*a*, red in the example, and the dots in e2 to h2 will be produced by the band 14*b*, blue in the example. The dot color for columns B, G and H will be the same as column A.

In column C, pins 15*a*, g and h are activated, whereby the dot a2 will be red and the dots g2 and h2 will be blue. Columns D, E and F will have a similar composition. Thus, the FIG. "8" will be made up of horizontal, alternating bands of red and blue. To subsequently alter the "8" would be very difficult because of the bands of colors.

It is to be understood that print head 15 is producing the other numerals and/or letters as it is moving across the check.

FIG. 4 depicts the amount $120.48 as it could be produced by the subject invention. A microprocessor (not shown) is associated with the mechanism which operates the print wires 15*a* to 15*h*. Each pair of adjacent bands of the amount is produced by the bands 14*a* and 14*b* of ribbon 14. Thus, for example, the letter "h" in "hundred" has five bands. In the example, the first, third and fifth bands would be red and the other two would be blue. The first two would be produced on the first pass of the print head, the next two would be produced on the next pass of the print head and the fifth band would be produced on the third pass of the print head. Similarly, the"8" in FIG. 4, is shown to be formed of six bands. The first, third and fifth bands would be red and the second, fourth and sixth bands would be blue. The "8" would be formed by three passes of the print head.

What has been described therefor is an improved check protector that imprints the amount in alpha and/or numeric characters consisting of alternating bands of color. These alternating bands make it very difficult to alter the amount.

What is claimed is:

1. Apparatus for printing on a medium images which are difficult to alter or forge, said apparatus comprising: platen means for carrying the medium, print head means mounted for reciprocally moving in successive passes relative to said platen means along a print line to print images on the medium, an inked ribbon disposed along the print line between the medium and said print head means, said inked ribbon being divided into a plurality of longitudinal color bands parallel to the print line and respectively having different colors, said print head means including a plurality of print wires arranged in a line perpendicular to the print line, different groups of said print wires being respectively aligned with said color bands, whereby the images imprinted on the medium will have a plurality of bands respectively imprinted in the different colors.

2. The apparatus of claim 1, wherein said inked ribbon is divided into two color bands.

3. The apparatus of claim 2, wherein said print head means includes an even number of said print wires with each of said groups of print wires including one-half of said print wires.

4. The apparatus of claim 1, wherein said print head means includes means for causing said print wires to print different portions of the images during consecutive passes of said print head means.

* * * * *